US005791590A

United States Patent [19]

Zuk et al.

[11] Patent Number: 5,791,590

[45] Date of Patent: Aug. 11, 1998

[54] UNIVERSAL REEL

[76] Inventors: Benjamin R. Zuk, 45 Circle Dr., Park Ridge, N.J. 07656; Michael Leiberman, 5929 Mclynn Avenue, Montreal, Quebec, Canada, H3X 2R3

[21] Appl. No.: 801,571

[22] Filed: Feb. 18, 1997

[51] Int. Cl.[6] ..... B65H 75/14

[52] U.S. Cl. ..... 242/610.6; 242/608.7

[58] Field of Search ..... 242/608, 608.7, 242/610, 610.2, 610.3, 610.6, 614, 118.8

[56] References Cited

U.S. PATENT DOCUMENTS

| | | | |
|---|---|---|---|
| 1,665,207 | 4/1928 | Howell . | |
| 1,696,473 | 12/1928 | De Vry . | |
| 2,341,491 | 2/1944 | Tucker et al. . | |
| 2,799,458 | 7/1957 | Nye | 242/118.8 |
| 3,876,073 | 4/1975 | Herbetko . | |
| 3,958,775 | 5/1976 | Liga . | |
| 4,244,538 | 1/1981 | Theros | 242/118.8 |
| 4,620,676 | 11/1986 | Missalla | 242/608.7 |
| 4,756,488 | 7/1988 | Cooke | 242/614 |
| 5,509,620 | 4/1996 | Crews . | |
| 5,513,819 | 5/1996 | Orange . | |

FOREIGN PATENT DOCUMENTS

| | | | |
|---|---|---|---|
| 37 03 018 A1 | 8/1987 | Germany | 242/608.7 |
| 3-83773 | 4/1991 | Japan | 242/614 |
| 2 165 214 | 4/1986 | United Kingdom | 242/608.7 |
| WO 93/01120 | 1/1993 | WIPO | 242/608.7 |

*Primary Examiner*—John P. Darling

*Attorney, Agent, or Firm*—Anthony J. Casella; Gerald E. Hespos; Ludomir A. Budzyn

[57] ABSTRACT

A reel design is provided which can be easily manufactured as blanks, efficiently stored, quickly assembled and disassembled, and compatible for use in a clean room. The reel is preferably formed from corrugated plastic and comprises two planar flanges, each formed with a plurality of grooves, and a hub secured therebetween, with a corresponding number of tabs integrally formed with the hub and capable of cooperative engagement with the grooves. The hub may be formed to define any diameter and either a cylindric or polygonal profile. Also, the flanges may be formed with grooves circumferentially disposed about the flanges at different locations to accommodate hubs of varying hub diameters.

15 Claims, 5 Drawing Sheets

UNIVERSAL REEL

BACKGROUND OF THE INVENTION

1. Field of the Invention

The subject invention relates to an electronic component storage device, and, more particularly, the invention is directed to a new and improved universal reel design.

2. Description of the Prior Art

Increasing complexity and miniaturization in the manufacture of electronic components has necessitated the development of clean rooms. A clean room is a room in which the concentration of airborne particles is controlled to specific limits to prevent the introduction of such particles into a manufactured item. For example, a semi-conductor chip may have a thickness measuring a fraction of an inch and yet comprise more than twenty layers and several thousand electronic components. During manufacturing, such semiconductor chips may require environs limited to an airborne contamination level as low as one particle per cubic foot of atmosphere less than 5 μm in size, since even one 5 μm particle may interfere with and denigrate the minute electrical connections disposed on the chip.

Equipment used in a clean room must be decontaminated to have surfaces relatively particle-free and comprise materials which do not chip, fray or give particles off in any such fashion. Material surfaces absorb moisture which provides a base for collecting hydrocarbons from the air, skin of individuals handling the equipment and residual oils from the manufacturing process. Dust and other airborne particles adhere to the collected hydrocarbons which are removed through decontamination procedures, such as, air or nitrogen-blowing, liquid spraying, wiping with a low-linting material, or immersion in an organic or fluorinated liquid.

In the electronics industry, reels are commonly used to store electronic components disposed onto a gummed or compartmentalized carrier tape by pick and place machines. Prior art reels are typically plastic, manufactured through injection molding to accommodate a significant number of relatively small electronic components, and often suitable for use in a clean room. Electronics manufacturing is substantially automated due to the storage of electronic components on reels, since reels provide an ideal storing method conducive to assembly line manufacturing where items can be stored in-line at equal intervals with identical orientations. Bulk shipments of components would require human intervention to arrange and orient the components in the assembly and manufacturing process, thereby incurring costs in time and money which are non-existent in a substantially or fully automated system.

Injection molded plastic reels, however, suffer from several drawbacks. First, inherent limitations in the injection molding process restrict the size of injection molded reels. To store relatively large electronic components, a reel is required with a relatively large hub and corresponding large flanges to efficiently accommodate a cost-effective number of stored items. Costs and technology of injection molding limit the size of a reel which can be manufactured by this process. Second, molds required for injection molding are relatively expensive, with such high costs limiting the number of reel designs. Also, the costs are unjustifiable in preparing a mold for a reel intended to accommodate a short-lived electronic component. Third, prior art reels basically comprise the same form with a cylindrical hub mounted between two planar, circular flanges. Electronic components having a substantial length may require storage in an unbent fashion and cannot be placed on a prior art reel which would conform the component to the hub's circumference and cause bending therein. Fourth, some prior art reels are formed so that, once assembled, either at the reel manufacturer or by the reel user, the reels cannot be readily disassembled. Thus, voluminous storage capacity is required to store assembled reels. Fifth, some prior art reels are not easily assembled, requiring gluing, riveting or ultrasonic welding.

Reels have been manufactured from corrugated materials, such as cardboard, in an attempt to overcome the shortcomings of injection molding and the prior art. One example is U.S. Pat. No. 5,509,620 to Crews which discloses a reel formed from corrugated cardboard. The Crews reel includes two flanges, formed with integral locking members, and a central hub, which is secured to the locking members with adhesive or staples. Although the Crews reel may be formed to any dimension, it cannot be readily disassembled, once assembled, and thus requires a considerable amount of storage volume. Also, the Crews reel is not suitable for clean room use since it is formed from cardboard, which may fray and emit particles which would corrupt a clean room environment.

U.S. Pat. No. 5,513,819 to Orange discloses a reel formed from a single blank comprising a corrugated material, such as cardboard or plastic. Like the Crews reel, the Orange design can be formed to any dimension. The Orange reel, however, is not easily manufactured and assembled since a series of complicated cuts and bends is required to prepare the blank and form the reel. Also, the flanges of the Orange reel extend circumferentially from the hub in radially outward directions. Accordingly, the flanges are annular shaped with open central portions corresponding to the diameter of the hub. Without central flange portions, the Orange reel cannot be mounted on a keyed drive shaft and be used for take up of a carrier tape.

It is an object of the subject invention to provide a universal reel design for use in a clean room.

It is also an object of the subject invention to provide a universal reel design capable of storing various shaped electronic components.

Yet another feature of the subject invention is to provide a universal reel design which can be easily manufactured as blanks, efficiently stored, and quickly assembled and disassembled.

SUMMARY OF THE INVENTION

The above-mentioned objects of the present invention are met by a new and improved universal reel design easily formed to any reel size which can be used in a clean room.

The subject reel design comprises two identical, planar flanges formed to engage a hub therebetween, the flanges and the hub being preferably formed from corrugated plastic blanks. Plastic, such as polypropylene or polypropylene-ethylene, which does not fray and is able to withstand methods of decontamination employed in clean rooms, may be used to form the corrugated plastic blanks. Also, anti-static additives may be added to the corrugated plastic which reduces the inherent attraction of the corrugated plastic to dust and particles and neutralizes any electrical charge which may be stored therein.

Corrugated plastic can be cut and bent much like corrugated cardboard. Any size hub or flanges may be cut from the corrugated plastic without any expensive molds, dies or patterns. The hub can be formed with a circular profile, defining any diameter, or a polygonal profile, defining any perimeter. Also, the flanges can be formed to accommodate various hub diameters and profiles. The new and improved reel design of the subject invention may be formed to any size and for any use without the limitations inherent in injection molding.

Corrugated plastic is relatively strong, especially in shear, due to the corrugated structure which comprises substantially parallel transverse ribs spaced throughout the material. The new and improved corrugated plastic reel of the subject invention is formed to orient the transverse ribs orthogonally to any material stored thereon. The ribs of the flanges are oriented in a direction perpendicular to the axis of rotation of the reel and in substantial alignment with the load when the reel is placed in a horizontal position. The hub is formed with a rib orientation parallel to the axis of rotation and aligned to substantially support the load of stored items with the reel being in a vertical position. The inherent strength of corrugated plastic allows the new and improved universal reel design of the subject invention to support a substantial weight.

The hub and the flanges of the subject invention may be joined through the use of cooperating members formed integrally with the hub and the flanges. In the preferred embodiment, the flanges are formed with several groups of paired circumferential grooves disposed concentrically about a central drive shaft aperture, and the hub is formed from a single blank bent to define a plurality of panels with flaps extending peripherally from every other panel and a semi-circular tab depending from each flap for engaging the flanges. Each pair of grooves formed in the flanges comprises an outer groove having a length greater than the width of the flaps of the hub, and an inner groove formed to define a length less than the diameter of the semi-circular tabs. The new and improved reel of the subject invention is assembled by placing the hub on one side of a flange, urging the flaps adjacent the flange through an outer set of grooves, folding the flaps and urging the semi-circular tabs through the inner set of grooves. This process is then repeated for the second flange. Once assembled, the reel can be mounted onto a drive shaft or other drive apparatus for take up of a carrier tape. Similar drive apparatus may also be used to unwind the carrier tape from the reel.

The hub may be formed with any number of panels or, alternatively, with no panels, thereby creating an unbent, cylindric hub. Also, the flanges and/or the hub, in any combination, may be formed from a thin, flexible, solid plastic sheeting, such as polypropylene sheeting, which is die cut and not corrugated.

The flanges can be formed with any shaped aperture for engaging a drive shaft apparatus, or alternatively, with no drive shaft aperture, with the reel of the subject invention being driven by an apparatus which does not utilize a drive shaft, such as a pair of spaced rollers.

The concentric grooves formed in the flanges allow a single pair of flanges to accommodate several diameter hubs, thereby reducing the inventory of flanges. Hub blanks are formed with different lengths to correspond to different hub diameters. Additionally, the hub and the flanges, which are formed as planar blanks, can be efficiently stored. The subject invention reel is also easily disassembled, which further reduces the required storage space and cost.

These and other features of the invention are better understood through a study of the following detailed description of the invention and the accompanying drawings.

DETAILED DESCRIPTION OF THE PREFERRED EMBODIMENTS

Figure 1:
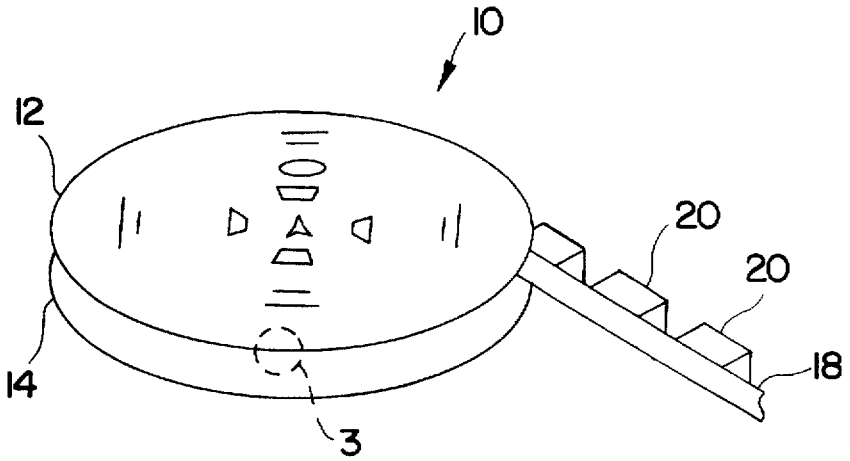
FIG. 1 is a perspective view of the new and improved reel design of the subject invention.
Figure 2:
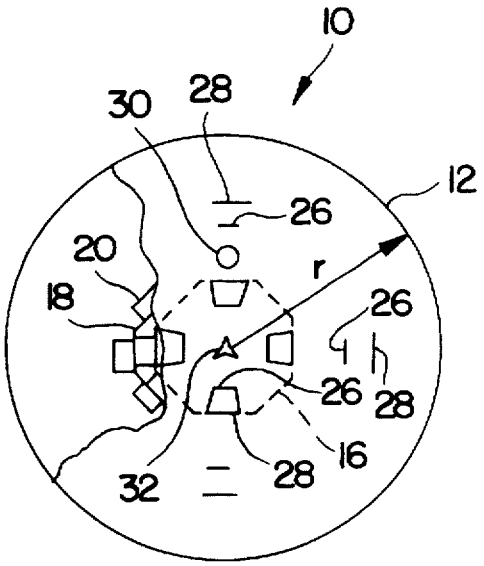
FIG. 2 is a plan view of the new and improved reel of the subject invention.

Referring generally to FIGS. 1 and 2, the new and improved reel design of the subject invention is generally indicated by reference numeral 10 and comprises two planar flanges 12, 14 disposed about a central hub 16. The reel 10 may be used to store a carrier tape 18 which may be formed with covered compartments 20 for housing electronic components. The carrier tape 18 may also be formed by two separate gummed layers, joined with gummed faces being in face-to-face engagement, wherein electronic components may be stored therebetween. The phrase "carrier tape", as used herein, is intended to cover all forms of film, tape, ribbon and substrate which are suitable for take up on a reel.

Figure 3:
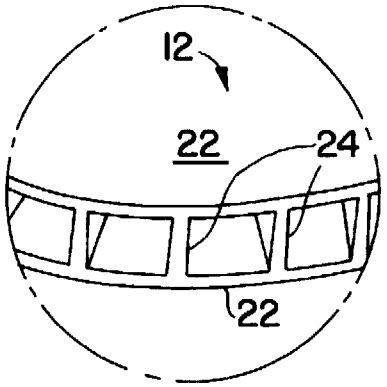
FIG. 3 is an enlarged view of the preferred corrugated structure view taken from the section numbered 3 of FIG. 1.

Preferably, the reel 10 is formed wholly from corrugated plastic. Referring to FIG. 3, the corrugated plastic is formed with two substantially parallel outer surfaces 22 and transverse ribs 24 disposed therebetween. The ribs 24 are oriented in the flanges 12, 14 perpendicular to the planes formed by the flanges 12, 14, whereas, the ribs 24 are oriented in the hub 16 as shown in the cut-away section of FIG. 4. The ribs 24 are to be oriented to support loads in shear, with the flanges 12, 14 substantially supporting a load with the reel 10 in a horizontal position and the hub 16 substantially supporting a load with the reel 10 in a vertical position. Alternatively, the flanges 12, 14 and/or the hub 16 may be formed from a solid, non-corrugated plastic sheeting (not shown) in any combination. The plastic sheeting must be sufficiently flexible to allow bending and forming, as described below.

In the first embodiment, the reel 10 is formed with the hub 16 having eight sides, as shown in FIG. 2. The flanges 12, 14 are identically manufactured which reduces the number of different parts stored in inventory and simplifies assembly through the use of identical parts. As shown in FIG. 2, the flanges 12, 14 can be cut to any radius "r" as may be desired. Pairs of through grooves, including short grooves 26 and long grooves 28, are circumferentially disposed about the flanges 12, 14 which extend through the entire thickness thereof. The grooves 26, 28 may be paired at different radii to accommodate a number of the hubs 16 having different hub diameters. As described below, the hubs 16 may be formed with either a circular or polygonal profile. All references to hub diameters herein are to a distance measured between opposing points on the circumference or perimeter of the hub 16, with the hub 16 having a circular or polygonal profile.

Each of the short grooves 26 corresponds to a long groove 28 within the flange 12, 14, with the short groove 26 being closer to the center of the flange 12, 14. A sight hole 30 is provided as a visual indicator of the amount of tape taken up onto the reel 10 during use, and a drive shaft aperture 32 is formed at the center of the flanges 12, 14 with radially extending grooves for accommodating keys found on a drive shaft. As previously disclosed, the drive shaft 32 may be formed with any shape to engage conventional drive shaft apparatus. Alternatively, the flanges 12, 14 can be formed without the drive shaft aperture 32.

Figure 4:
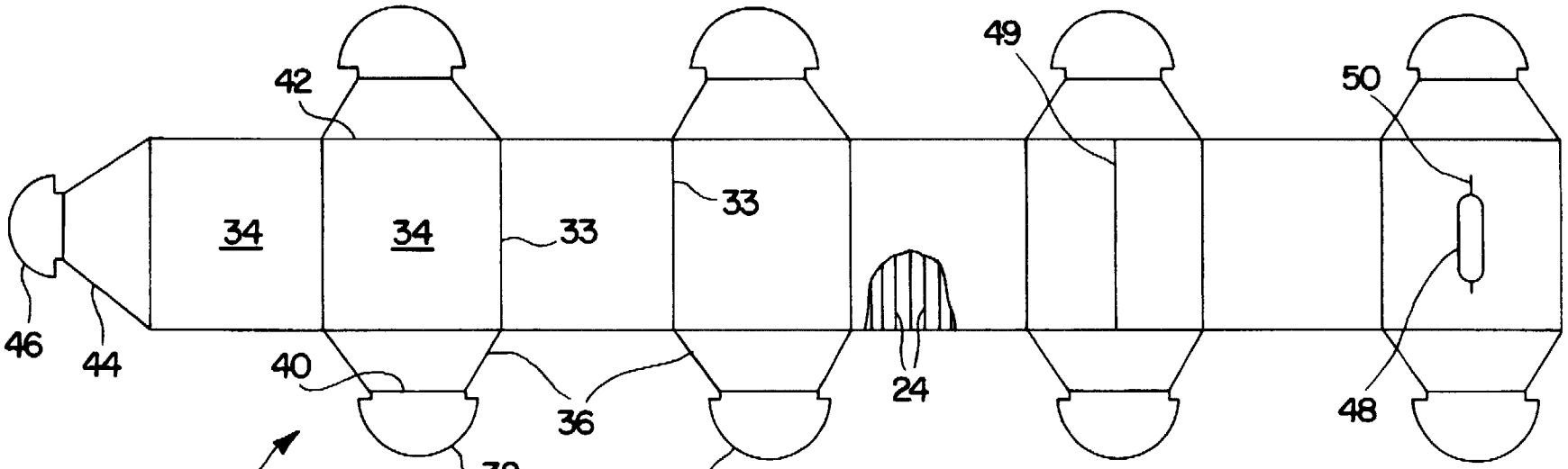
FIG. 4 is a plan view of the first embodiment of the hub.

Referring to FIG. 4, the hub 16 is formed as a unitary member bent along fold lines 33 to define a plurality of panels 34. A flap 36 extends from the periphery of every other of the panels 34, with a semi-circular tab 38 depending therefrom. The flaps 36 and the tabs 38 are joined to each other and the panels 34 through fold lines 40, 42 respectively, which allow the flaps 36 and the tabs 38 to bend relative to the panels 34. A locking tongue 44 is provided with a semi-circular ear 46. In the panel 34 located at the opposite end of the hub 16 from the locking tongue 44, a locking groove 48 is formed therein with a longitudinal length less than the diameter of the semi-circular ear 46. The end of the carrier tape 18 may be forced into feed slot 49 to initiate winding of the carrier tape 18 onto the reel 10. Since the feed slot 49 may extend the length of the panel 34 and through the entire thickness of the material forming the panel 34, the feed slot 49 must be formed in one of the panels 34 from which the flaps 36 and the tabs 38 depend, so that the flaps 36 maintain the hub 16 intact about the feed slot 49. Slits 50 may also be formed at the ends of the locking groove 48 to ease the insertion of the ear 46 therethrough.

The quantity and location of the grooves 26, 28 formed in the flanges 12, 14 are dependent on the length of the hub 16 and the number of the flaps 36 and the tabs 38 formed therewith. The flanges 12, 14 must be formed to define the number of pairs of the grooves 26, 28 to correspond to each of the flaps 36 and the tabs 38 extending along one edge of the hub 16. For example, as shown in FIG. 4, the hub 16 is formed with four of the flaps 36 and four of the tabs 38 extending from one edge of the hub 16. Correspondingly, as shown in FIG. 2, the flanges 12, 14 are formed with four pairs of the grooves 26, 28. The overall length of the hub 16 may be adjusted to accommodate various hub diameters with accompanying adjustments to the widths of the panels 34. The length of the hub 16 must be increased to increase the hub diameter, and the length of the hub 16 is decreased to reduce the hub diameter.

Figure 5:
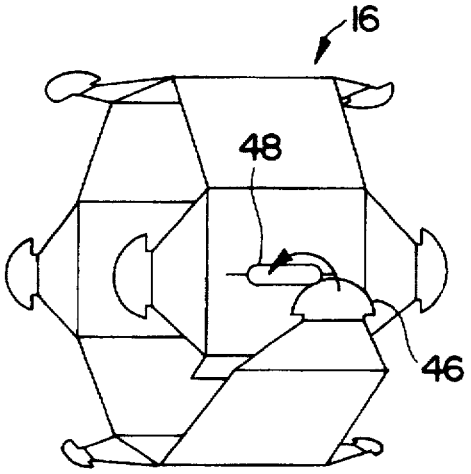
FIG. 5 is a perspective view showing the assembly of the first embodiment of the hub.
Figure 7:
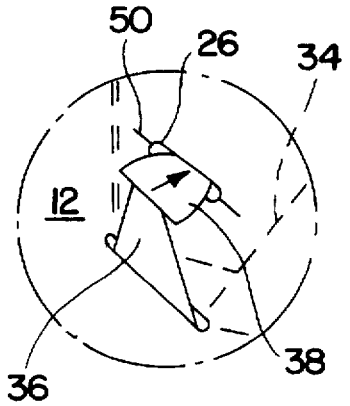
FIG. 7 is an enlarged view of the flap and tab construction taken from FIG. 6.

As shown in FIG. 5, the hub 16 is assembled by urging the semi-circular ear 46 through the locking groove 48. Since the diameter of the ear 46 is greater than the longitudinal length of the locking groove 48, the ear 46 will engage the inner surface of the panel 24 in which the locking groove 48 is formed. The assembled hub 16 has an eight-sided polygonal profile with the panels 34 forming each of the sides. The panels 34 may be formed to accommodate electronic components having a substantial length which require storage in an unbent fashion adjacent flat surfaces.

Figure 6:
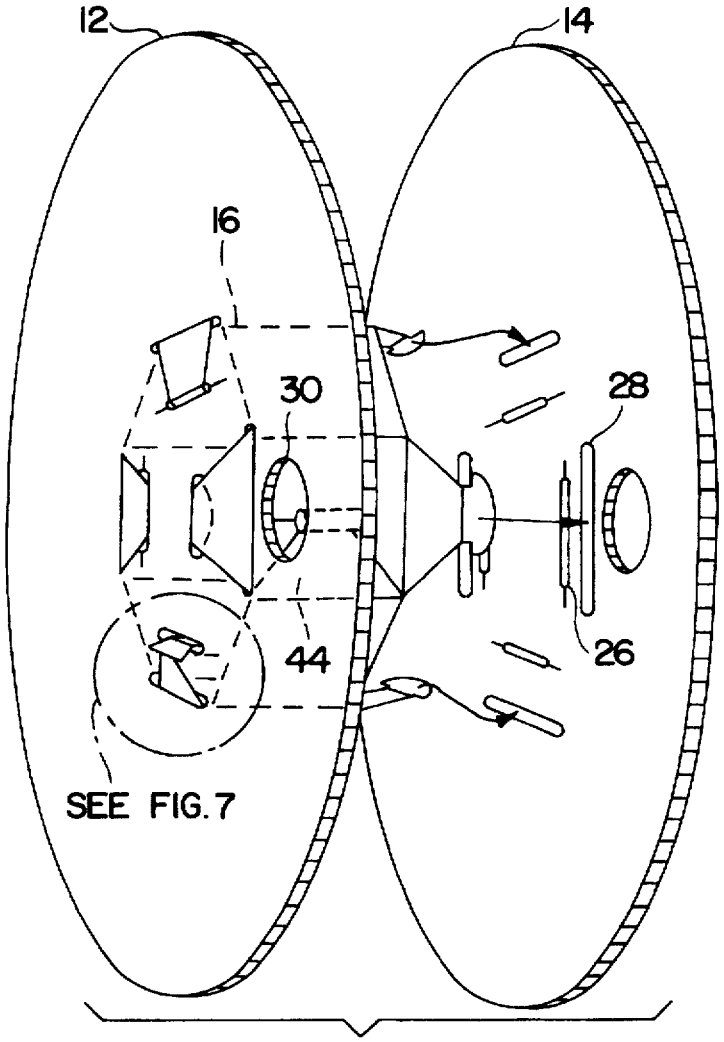
FIG. 6 is a perspective view showing the assembly of the first embodiment of the new and improved reel of the subject invention.

The long grooves 28 are formed with a length greater than the fold lines 42, thereby, allowing the flaps 36 to pass therethrough. The short grooves 26 are formed with a length less than the diameter of the semi-circular tabs 38. The slits 50 may also be provided at the longitudinal ends of the grooves 26, 28 to assist in assembling the reel 10. As shown in FIG. 6, the reel 10 is assembled by placing the hub 16 adjacent one of the flanges 12, urging the flaps 46 through the long grooves 28, folding the flaps 46 and urging the semi-circular tabs 38 through the short grooves 26. The feed slot 49 may be aligned with the sight hole 30 to provide visual access to the procedure of securing the carrier tape to the feed slot 49. With the hub 16 secured to one of the flanges 12, the process is then repeated for the second flange 14. Once assembled, the reel 10 may be used for take up of the carrier tape 18, transported with the wound carrier tape 18, and used for unwinding delivery of the wound carrier tape 18 to a desired location.

Figure 8:
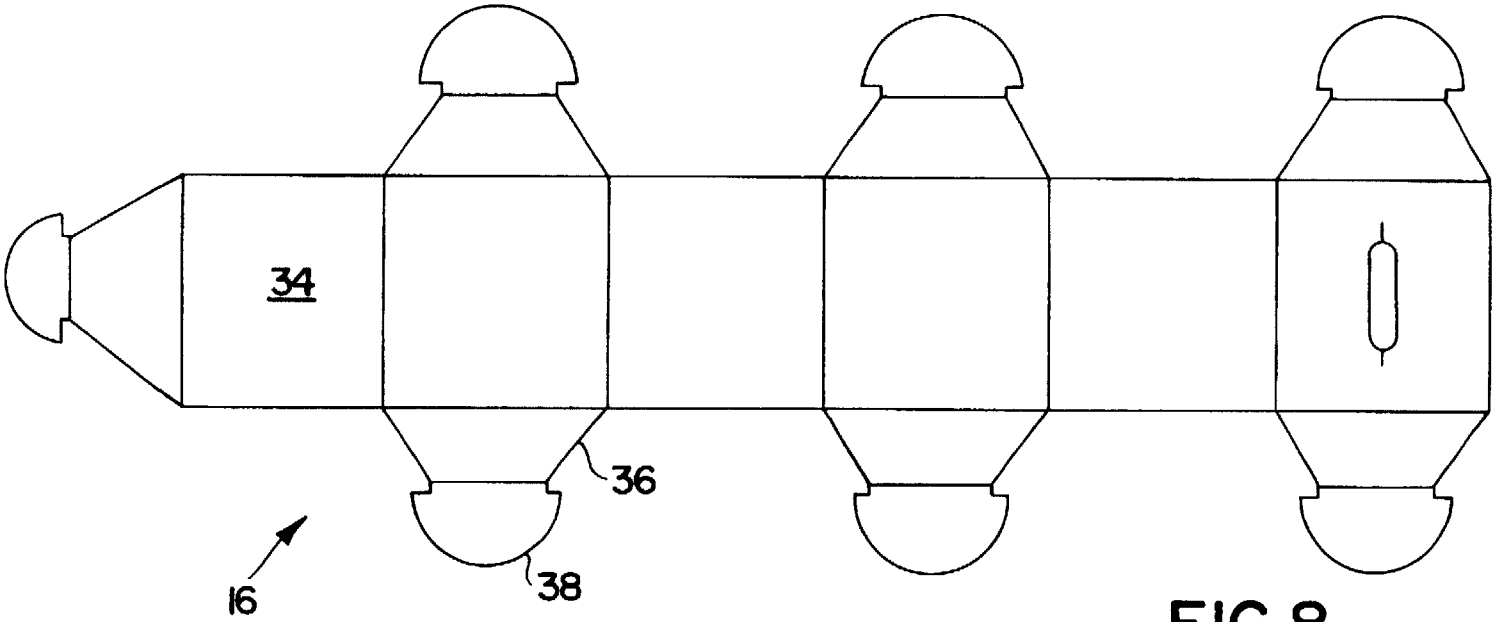
FIG. 8 is a plan view of an alternative embodiment of the hub.
Figure 9:
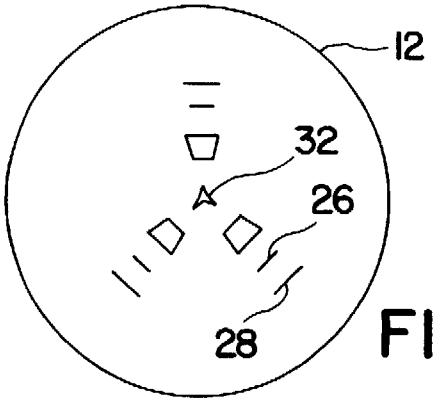
FIG. 9 is a plan view of an alternative embodiment of the new and improved reel of the subject invention.
Figure 10:
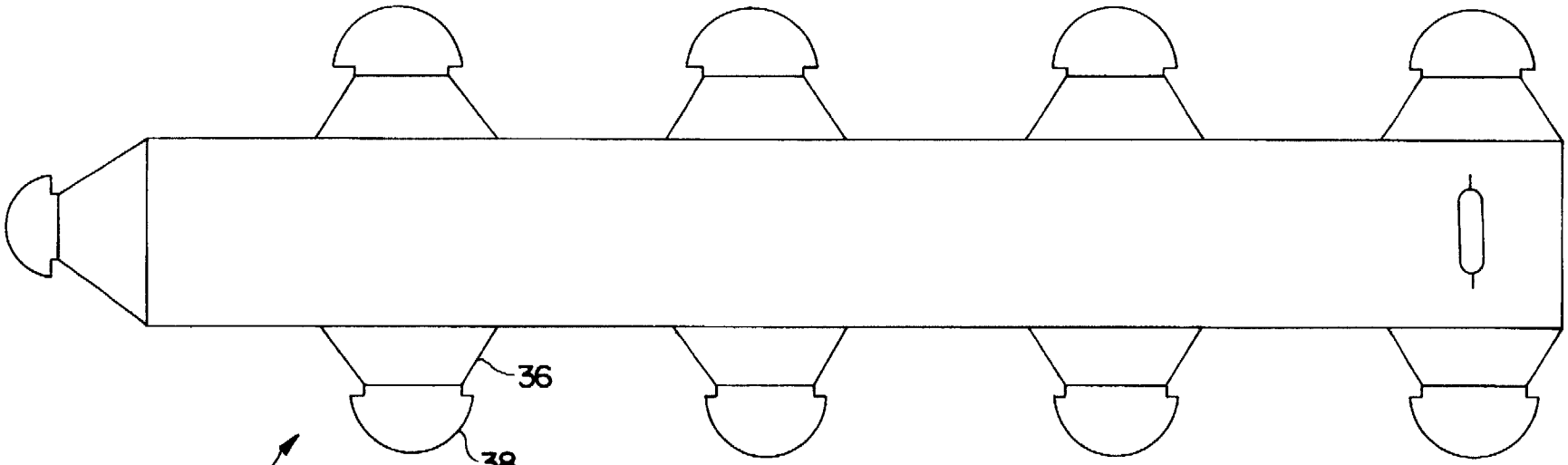
FIG. 10 is a plan view of an alternative embodiment of the hub.

Additionally, the hub 16 may be formed with any number of the panels 34 or without any panels as one continuous, unbent member, which would form the hub 16 as a cylinder. The grooves 26, 28 are formed in the flanges 12, 14 to correspond with the number of the flaps 36 and the semi-circular tabs 38 formed along one edge of the hub 16. For example, as shown in FIGS. 8 and 9, the hub 16 may be formed with six of the panels 34, with three of the flaps 36 and the tabs 38 extending from both of the longitudinal edges of the hub 16. Correspondingly, the flanges 12, 14 are formed with three pairs of the grooves 26, 28 being circumferentially disposed about the central aperture 32. As a further example, as depicted in FIG. 10, the hub 16 may be formed without the fold lines 33 and the panels 34, with eight of the flaps 36 and the tabs 38 extending from the unbent hub 16. The flanges 12, 14 shown in FIGS. 1 and 2 would accommodate the unbent hub 16 shown in FIG. 10. The length of the electronic components and the necessity to avoid bending may determine the profile of the hub 16, be it polygonal or circular. As is readily apparent, the hub 16 may be formed to any length with a circular or polygonal profile.

Figure 11:
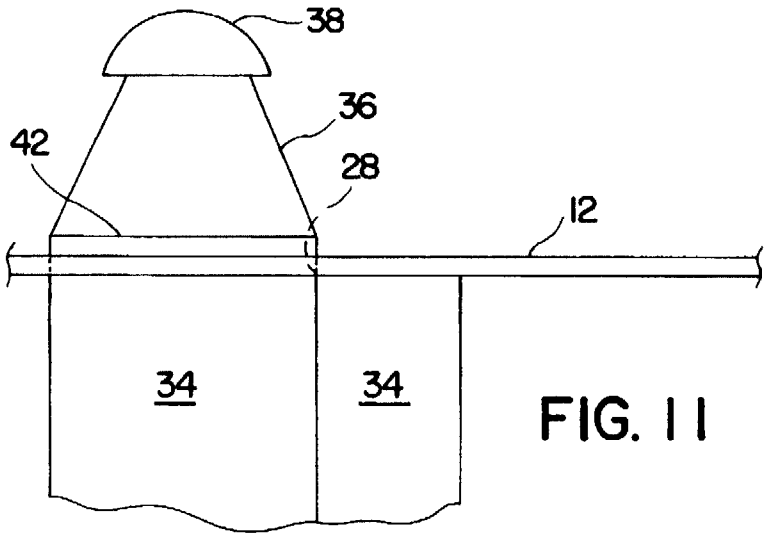
FIG. 11 is a partial elevation of an alternative embodiment of the subject invention.

Furthermore, in any embodiment of the invention, the panels 34 which support the flaps 36 may be formed with a greater length than the panels 34 which do not support any flaps 36, as shown in FIG. 11. Once assembled, the length added to the panels 34 which support the flaps 36 will allow portions of the respective panels 34 to extend through the long grooves 28 along with the flaps 42. The panels 34 can be formed with the additional length to compensate for the thickness of the material used to form the hub 16. When assembled, the fold lines 42 will be spaced from the outer surfaces of the flanges 12, 14. The added length will allow the flaps 36 to be bent to substantially 90 degree angles relative to the respective panels 34 along the fold lines 42 and to extend between the respective long grooves 28 and the respective short grooves 26. Without the added length, the flaps 42 may not bend to substantially 90 degree angles and/or allow the semi-circular tabs 38 to reach the short grooves 26.

As is readily apparent, numerous modifications and changes may readily occur to those skilled in the art, and hence it is not desired to limit the invention to the exact construction and operation shown and described, and accordingly all suitable modification equivalents may be resorted to falling within the scope of the invention as claimed.

What is claimed is:

1. A reel for storing carrier tape and items disposed thereon, said reel comprising:

two substantially planar flanges, each formed with opposing inner and outer surfaces with a plurality of grooves extending therebetween, said plurality including at least one first short groove, at least one first long groove, at least one second short groove, and at least one second long groove, each said flange being formed about a center, said first short groove being located a first distance from said center, said first long groove being located a second distance from said center, said second short groove being located a third distance from said center, and said second long groove being located a fourth distance from said center, each said distance being different, wherein each said groove having an inner surface defining a length; and a hub having opposing ends with portions of each said end being in contact with the inner surface of a single said flange, said hub formed to define at least one flap extending from each said end with a semi-circular tab depending from each said flap, wherein the length of said first long grooves is greater than the width of said flaps and the length of said first short grooves is less than the diameter of said semi-circular tabs, and wherein said flaps extend through said first long grooves and said tabs are in engaging contact with the inner surfaces of said flanges adjacent said first short grooves, whereby said hub can alternatively cooperate with said second short and lone grooves.

2. A reel as in claim 1, wherein said hub and said flanges are formed from corrugated plastic.

3. A reel as in claim 1, wherein said hub is formed with a polygonal profile.

4. A reel as in claim 1, wherein said hub is formed with a circular profile.

5. A reel as claim 1, wherein said flaps extend from portions of said hub not in contact with the inner surfaces of said flanges, and wherein at least one fold line is formed on each said flap spaced from said outer surfaces of said flanges.

6. A reel as in claim 1, wherein the length of said second long grooves is greater than the width of said flaps and the length of said second short grooves is less than the diameter of said semi-circular tabs.

7. A set of blanks for forming a reel, said set comprising:

two substantially planar flange blanks each formed with a plurality of through grooves, said plurality including at least one first short through groove, at least one first long through groove, at least one second short through groove, and at least one second long through groove, each said flange blank being formed about a center, said first short through groove being located a first distance from said center, said first long through groove being located a second distance from said center, said second short through groove being located a third distance from said center, and said second long through groove being located a fourth distance from said center, each said distance being different, wherein said through grooves having inner surfaces each defining a length; and a hub blank having an elongated central portion formed with two ends and opposing longitudinal edges with at least one flap extending from each said longitudinal edge, each said flap being formed with a depending tab, wherein said central portion, said flaps and said tabs are hingedly connected through fold lines, said tabs formed to define a dimension greater than the length of at least a portion of said short through grooves, said flaps formed to define a width less than the length of at least a portion of said long through grooves, wherein said hub further having a locking tongue extending from one said end of said central portion with a semi-circular ear depending therefrom, a locking through groove being formed adjacent other said end of said central portion, with said semi-circular ear formed to define a diameter and said locking through groove having an inner surface defining a length less than said diameter.

8. A set of blanks as in claim 7, wherein said flange blanks and said hub blank are formed from corrugated plastic.

9. A set of blanks as in claim 7, wherein said flange blanks further define slits extending from said through grooves and wherein said hub blank further defines slits extending from said locking through groove.

10. A set of blanks as in claim 7, wherein said central portion of said hub blank is formed with transverse fold lines to define a plurality of panels.

11. A set of blanks as in claim 10, wherein a plurality of said flaps is provided along each said longitudinal edge and wherein said flaps extend from every other said panel.

12. A set of blanks as in claim 11, wherein said panels are formed with varying lengths such that said longitudinal edges are not parallel.

13. A set of blanks as in claim 12, wherein said every other said panel from which said flaps extend are formed with greater lengths than said panels from which said flaps do not extend.

14. A set of blanks as in claim 7, wherein the quantity of said at least one flap extending from one said longitudinal edge corresponds to the quantity of said first short through grooves formed in one said flange blank.

15. A set of blanks as in claim 7, wherein said tabs are formed to define a dimension greater than the length of each said short through groove, and said flaps are formed to define a width less than the length of each said long through groove.

* * * * *